US005082012A

United States Patent [19]

Massey et al.

[11] Patent Number: 5,082,012

[45] Date of Patent: Jan. 21, 1992

[54] SIMPLIFIED APPARATUS FOR DECONTAMINATING ELECTRICAL APPARATUS CONTAMINATED WITH PCBS

[75] Inventors: Michael J. Massey, Houston, Tex.; David R. Hopper, Concord, Mass.; Mark N. DeDecker, Massillon, Ohio

[73] Assignee: Ensr Corporation, Houston, Tex.

[21] Appl. No.: 547,546

[22] Filed: Jul. 2, 1990

Related U.S. Application Data

[63] Continuation of Ser. No. 322,498, Mar. 13, 1989, abandoned, which is a continuation-in-part of Ser. No. 78,480, Jul. 27, 1987, Pat. No. 4,814,021, which is a continuation-in-part of Ser. No. 891,612, Aug. 1, 1986, abandoned.

[51] Int. Cl.[5] ..... B08B 3/10

[52] U.S. Cl. ..... 134/109; 202/170; 203/DIG. 14; 210/909

[58] Field of Search ..... 134/109, 12, 11; 68/18 R, 18 C; 210/909; 202/170, 182, 185.2; 203/DIG. 14

[56] References Cited

U.S. PATENT DOCUMENTS

| | | | |
|---|---|---|---|
| 3,468,761 | 9/1969 | Stalcop | 203/DIG. 14 |
| 4,299,704 | 11/1981 | Foss | 210/909 X |
| 4,425,949 | 1/1984 | Rowe, Jr. | 134/11 X |
| 4,685,972 | 8/1987 | Fowler | 134/109 X |
| 4,790,337 | 12/1988 | Fowler | 134/109 |
| 4,879,004 | 11/1989 | Oesch et al. | 202/170 X |

*Primary Examiner*—Philip R. Coe

[57] ABSTRACT

Energy efficient apparatus of compact size and configuration for the decontamination of the PCB contaminated fluid removed from transformers is disclosed. The apparatus includes a fluid circulation loop with a side stream to a distillation means followed by a venturi for reintroducing the vapors of distillation into the circulating loop of contaminated fluid.

8 Claims, 3 Drawing Sheets

SIMPLIFIED APPARATUS FOR DECONTAMINATING ELECTRICAL APPARATUS CONTAMINATED WITH PCBS

RELATED APPLICATIONS

This is a continuation of application Ser. No. 07/322,498 filed Mar. 13, 1989, abandoned, which is a CIP of Ser. No. 07/078,480, filed Jul. 27, 1987, now patented as U.S. Pat. No. 4,814,021, which is a CIP of Ser. No. 06/891,612, filed Aug. 1, 1986, abandoned.

BACKGROUND OF THE INVENTION

The present invention relates to an apparatus for use in the decontamination of an apparatus, such as an electrical transformer, contaminated with polychlorinated biphenyls (PCBs). More specifically, the present invention relates to an apparatus for decontaminating PCB contaminated electrical transformers characterized by its simplicity and ease of operation and primarily by its compact size and its ability to manage heat and operate without the need for someone to be in attendance. In particular, the present invention relates to a simple and easily operated apparatus for decontaminating PCB contaminated transformers which is designed such that the heat which is generated during the operation of the electrical transformer or portion of the heat which is used in the removal of the PCBs from the transformer fluid is used to enhance the rate of removal of the PCBs from the electrical transformer.

For many years PCBs have been used as an insulation or dielectric fluid in the electrical apparatus industry as a safe, fire-resistant material. In the late '60s and early '70s, it was discovered that PCBs were hazardous environmental contaminants, and their use was discontinued; however, by that time many pieces of electrical apparatus had been built using PCBs. The primary use of PCBs is in electrical transformers and electrical capacitors as a coolant dielectric fluid. Accordingly, the need has risen to economically remove the PCBs from such electrical apparatus as electrical transformers. Transformers using PCBs as the dielectric or coolant fluid all had a common construction in that they contained a cellulosic material as insulation, usually paper, wrapped on and around a wire that comprises the majority of the core of the transformer. Also commonly included in the construction of such transformers are wood structures acting as insulators. Because of the porosity of these two major items used in construction of the transformer, the interior of the transformer acted somewhat like a sponge and the PCBs became impregnated into these materials. Consequently, attempts to simply remove the PCBs and in a single operation refill the transformer with another coolant dielectric fluid has failed to reduce the PCBs below the accepted U.S. Environmental Protection Agency (EPA) levels for a non-PCB transformer. To be reclassified as a non-PCB transformer by EPA standards, the level of PCBs in the transformer must be maintained at less than 50 parts per million (ppm) for at least three months. Thus, to reach these levels and satisfy the non-PCB standard, the PCBs which have become impregnated in the materials of the core as well as the dielectric fluid used in the transformer must be removed.

The present invention is directed to an apparatus used to decontaminate and thereby reclassify PCB-contaminated electrical apparatus which had operated with PCBs as the coolant dielectric fluid. In contrast to the prior art which has focused its attention primarily on the processes or methods for removing the PCBs from the electrical apparatus, the present invention is specifically directed to a compact apparatus having a size such that it can be placed into a building through the conventional spaces and doorways and can operate unattended while easily and effectively removing the PCBs from a contaminated electrical apparatus.

In the cleanup or reclassification of transformers, several processes or methods have been disclosed. A single refilling step is disclosed in U.S. Pat. No. 4,425,949, where the electrical apparatus, for example a transformer, is flushed with a heat stable fluid, such as perchloroethylene or Freon 113. Discussions of the problem of cleaning PCBs and PCB-contaminated electrical apparatus, particularly transformers, are found in U.S. Pat. Nos. 4,483,717 and 4,312,794.

U.S. Pat. Nos. 4,744,905 and 4,738,780 disclose retrofilling processes for replacing PCB-containing coolants in electrical induction apparatus with substantially PCB-free dielectric coolants. Both of these patents emphasize the steps utilized in a retrofilling process which require the repeated draining and refilling of the transformer to decontaminate the electrical apparatus and also emphasizes the specific dielectric fluids to be used in the method.

U.S. Pat. No. 4,685,972 discloses the process for removing PCBs from electrical apparatus. In the two drawings of this patent, the apparatus consists of a still for separating the dielectric fluid/solvent from the PCBs, a condenser for condensing the dielectric fluid/coolant and any water, a water separator to separate any water from the dielectric fluid/solvent and returning the water to the still, and a condensate tank for holding the condensed dielectric fluid/solvent before recirculating to the transformer. The two figures show alternate cooling units for the dielectric fluid which is disclosed as Freon 113.

The disadvantages of the processes and methods of the prior art are that they either generate a very large volume of contaminated fluid with more than 500 ppm of PCBs and require long periods of time to satisfy the non-PCB transformer standard or they include complicated processing equipment and steps for the removal of the PCBs. Some processes of the prior art require that the service of the electrical transformer be interrupted for long periods of time or many times during the decontamination process to satisfy the non-PCB transformer standard. Furthermore, the prior art disclose no provisions for heat management or heat recovery or use of temperature control in the electrical apparatus.

The apparatus of the present invention is applicable to a retrofill process or a continuous process for removal of the PCB-contaminated dielectric fluid and overcomes the disadvantages of the prior art methods and apparatus. It is an object of the apparatus of the present invention to provide heat management both in the electrical transformer during the reclassification period as well as the apparatus employed in the reclassification of the transformer. The heat used in the decontamination of the PCB contaminated transformer fluid, preferably incorporated into the distillation which separates the PCBs from the circulating dielectric fluid, is returned to the transformer to improve the rate of PCB removal therein from the transformer while the temperature within the transformer is continuously controlled.

It is another object of the present invention to provide an apparatus of compact size such that it can carry out the reclassification of transformers in buildings and the like. Often times the contaminated transformer is in the basement of a building restricted by doorways, elevator shafts or other restrictions which prevent the use of prior equipment but are not obstacles of the apparatus of the present invention. The apparatus of the present invention can be easily operated, on site and unattended without any substantial interruption in the operation of the contaminated transformer.

SUMMARY OF THE INVENTION

The present invention relates to an improved apparatus used in the decontamination of electrical apparatus, such as electrical transformers, contaminated with PCBs. The unique features of the apparatus of the present invention are its compact size and configuration and its ability to recover and return to the transformer part of the heat incorporated in the decontamination of the PCB contaminated fluid which is removed from the contaminated transformer. The heat which is returned to the transformer and the heat which is generated during the operation of the transformer are used to increase the PCB leaching rate from the materials of the core and thereby accelerate the time necessary to satisfy the non-PCB transformer standard. The apparatus of the present invention has a temperature controller for controlling the temperature within the electrical transformer and provides various configurations of equipment, primarily heat exchange devices, which provide effective heat management within the system. One specific heat exchange device is a venturi which receives all of the overhead vapor stream from a distillation column used to separate the contaminants such as PCBs from the dielectric fluid and condenses the vapor and thereby captures the heat in the circulating fluid returning to the transformer. Another heat exchange device which may be part of the apparatus of the present invention is a liquid-vapor heat exchanger wherein the dielectric fluid removed as a liquid from the transformer is heated by the overhead vapor stream from a distillation column before the removed liquid is distilled. The liquid-vapor heat exchanger serves to recover the heat from the overhead vapor which otherwise would be lost and to heat the circulating fluid before it is distilled thereby reducing the heat requirement of the distillation column. The apparatus of the present invention may have one or more than one feature, i.e. energy saving or heat exchange devices, all which are directed to enhance and manage the heat which is captured and returned to the electrical transformer.

DETAILED DESCRIPTION OF THE PREFERRED EMBODIMENTS

Figure 1:
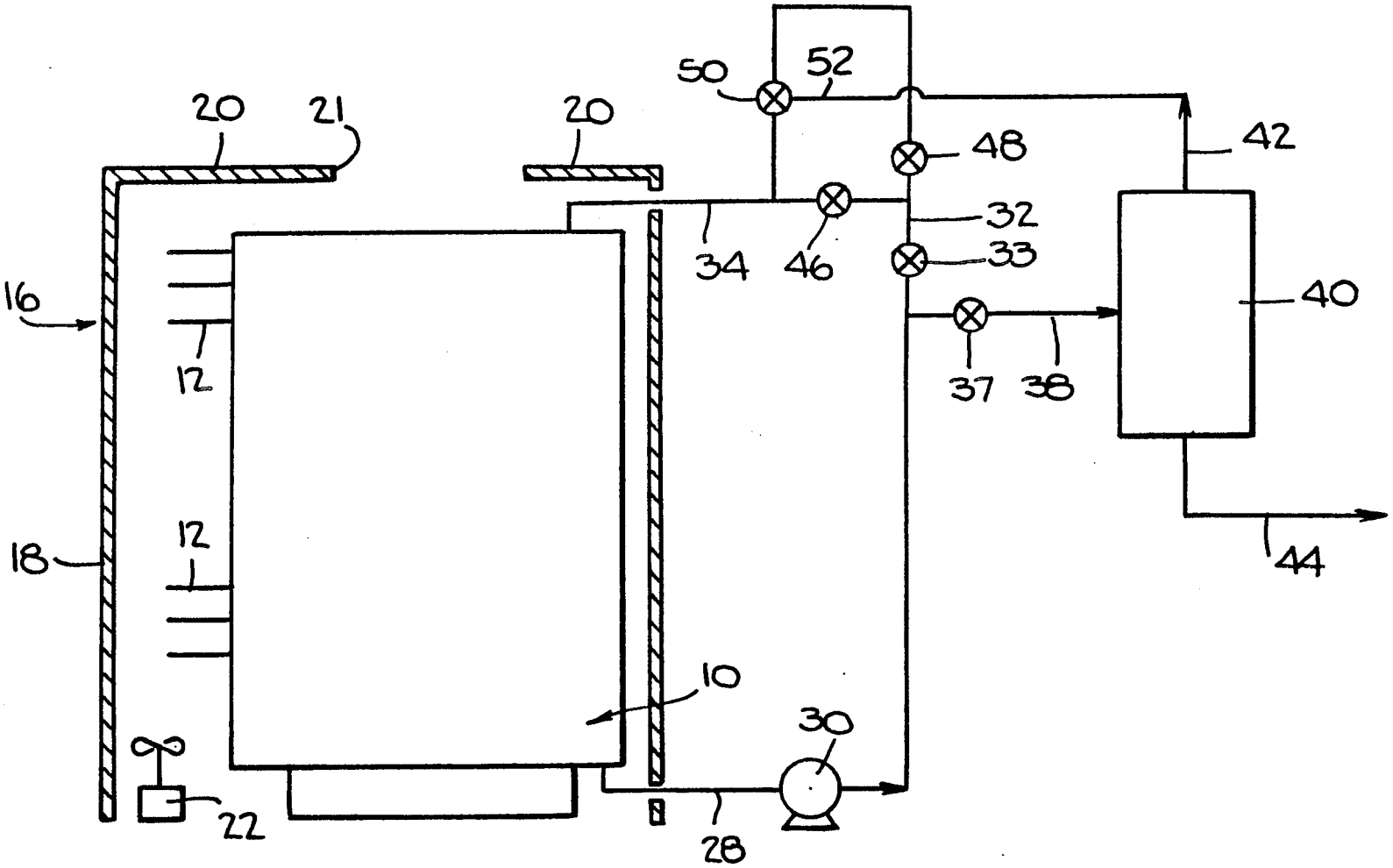
FIG. 1 is a schematic flow sheet of the apparatus of the present invention as used to decontaminate a PCB-contaminated electrical transformer.

The PCB compounds normally used in the past in electrical apparatus, particularly transformers, were usually a wide range of PCB cogeners which boiled in the range of about 250° to about 550° C. Commonly used PCB-containing fluids were called askarals which were mixtures of biphenyls having differing degrees of chlorination in a trichlobenzene (TCB) solvent; for example, common mixtures contained about 50% to about 85% mixed PCBs and, correspondingly, from about 15% to about 50% chlorinated benzene TCB. Several processes or methods have been proposed for the cleanup or reclassification of transformers and satisfy the non-PCB transformer standard. The present invention relates to an apparatus of compact size designed to operate unattended which is used to decontaminate and thereby reclassify PCB-contaminated electrical apparatus such as a transformer which had operated with PCBs as the coolant dielectric fluid.

The apparatus of the present invention can be best understood in its use in reclassifying or decontaminating an electrical PCB contaminated transformer. It is most desirable that the methods employed to reclassify the transformer permit the transformer itself to be in operation. In the operation of the transformer, the amount of electrical current being passed through the transformer as it performs its operating function will vary from zero to the full capacity of the transformer depending on the electrical load applied. This varying load creates a variable amount of heat. It is the function of the dielectric fluid to dissipate this heat. During the decontamination or reclassification process, it is desirable to elevate the temperature of the fluid during the operation of the transformer because it enhances the rate of removal of the PCBs entrapped in the internal materials or structure of the transformer. The apparatus of the present invention manages the heat in the transformer by maintaining an optimum elevated temperature within the transformer thereby reducing the time required for removing the entrapped PCBs. This is done by regulating the amount of internally generated heat which is released from the transformer. The temperature of the dielectric fluid within the transformer should be high enough to enhance the leaching rate of the PCBs from the core into the dielectric fluid; however, the temperature of the dielectric fluid should be maintained below the fluid's boiling point to avoid the need for special equipment for handling any vapor which would be created.

To reclassify a contaminated electrical piece of equipment, illustrated by a transformer which had used PCBs as the dielectric fluid, the transformer is generally shut down and drained to remove the bulk of the PCBs therefrom The transformer is then preferably washed with an amount of PCB-free dielectric fluid, of from about 1 to about 200%, more preferably about 5 to about 20% of the transformer's volume, to remove any major puddles of entrapped PCBs within the transformer's core or casing. The liquid PCB-free dielectric fluid or solvent is dispersed throughout the core to flush out fins or radiators or other parts of the transformer. This solvent is then removed from the transformer and either stored at the site for further processing or is cleaned by using the apparatus of the present invention as hereinafter described to separate the PCBs from the fluid. During the shutdown of the transformer and this draining step, maintenance can be performed on the transformer to change gaskets, provide line attachments and the like.

This initial draining and flushing or cleaning step of the transformer is in accordance with procedures well known to the industry in preparation for reclassifying a PCB transformer. During this initial draining and rinsing operation, the transformer may be conveniently fitted with connections, and valves and lines for connecting the apparatus of the present invention as well as introducing a PCB free dielectric fluid, such as refilling the transformer with a dielectric fluid different from the PCBs and/or fluid used in cleaning or flushing the transformer.

In the practice of the present invention, a preferred reclassification fluid is perchloroethylene, boiling point about 120° C. or mixtures having similar boiling points. Examples include pure substance having less than about 100 ppm chlorohydrocarbon contaminants as described in U.S. Pat. No. 4,312,794, an inhibited perchloroethylene as described in U.S. Pat. No. 4,293,433 and U.S. Pat. No. 4,697,043, all of which are incorporated herein by reference for all purposes of the disclosure therein made. The reclassification fluid has a boiling point which enables the simple and easy separation of the reclassification fluid from the PCBs by distillation. Perchloroethylene is a coolant dielectric fluid suitable for use in transformers and when employed in the core of the transformer, the transformer can be operated during the reclassification process. Perchloroethylene is nonflammable and is a good solvent for PCBs. It is important, as is well known to those skilled in the art, to avoid exposure of the transformer core to oxygen and moisture. While perchloroethylene is the preferred reclassification fluid, the specific aspects of the apparatus of the present invention may be incorporated in apparatus using other cleaning or reclassification fluids such as trichlorobenzene or Freon 113.

Apparatus heretofore described has not recognized the effect of temperature control in the transformer and heat conservation in the reclassification apparatus in enhancing the PCB leaching rate from the core of the transformer into the dielectric fluid. Because of inefficiencies of design of such apparatus, the energy levels required to operate these devices are much greater than the apparatus of the present invention. The apparatus of the present invention incorporates energy saving devices which improve the efficiency of the apparatus as a reclassifying apparatus for a PCB transformer and still maintain the compact size necessary for the apparatus to be used inside buildings or other situations where space is limited.

Referring now to FIG. 1 for a more specific description of some of the specific aspects of the present invention. A transformer 10 is assembled for reclassification. The transformer 10, especially when it is a power transformer, has external heat exchange fins 12. These fins 12 are air-cooled by the air surrounding the transformer 10 and act in the same manner as a radiator. In the operation of the transformer, when current is passing through the transformer 10, heat is generated and the cooling dielectric fluid is heated. To cool the dielectric fluid in the transformer 10, the fins 12 provide heat exchange surface for the transformer and aid in cooling the dielectric fluid contained therein.

In one aspect of the present invention, heat-containment means 16 are placed around the transformer so that the flow of air over the fins 12 is limited. The heat-containment means 16 includes a baffle 18 which surrounds the transformer 10. The purpose of the baffle is to confine a defined amount of air in contact with the heat exchange fins 12 surrounding the transformer 10 and therefore, control the extent of heat exchange between the transformer 10 and the surrounding air by the circulation of that defined amount of air thereby maintaining the temperature of the cleaning or reclassifying fluid at an optimum elevated temperature. The optimum elevated temperature is sufficiently below the boiling point of the reclassifying fluid so that there is not a substantial amount of reclassifying fluid vapor formed in the transformer. The temperature is to control the amount of vapor pressure of the reclassifying fluid in the transformer 10 and to avoid an excessive temperature that could damage the internals of the transformer 10. For most transformers, the optimum maximum temperature is about 70 to 80° C. The transformer 10 may have a circular cross section body or any other shape and the fins extending radially, in most instances from the circular- or rectangular-shaped body of the transformer 10. Thus, the baffle 18 will surround the transformer 10 and may be of circular or rectangular configuration and extends in one dimension, vertically, to essentially cover the heat exchange fins 12. As shown in FIG. 1, this vertical dimension of baffle 18 is from below the lowest fins 12 and extends to above the top of the body of the transformer 10. Baffle 18 also has an upper portion 20 which extends horizontally and covers the top of transformer 10 except for an opening 21 which has a defined cross-section. Thus, baffle 18 confines a defined volume of air between the baffle 18 and the transformer 10 which is moved in contact with the fins 12 for cooling the reclassification fluid in the transformer 10. Between the baffle 18 and the transformer 10, or within the baffle 18, is a fan 22 which is turned on and off, and controlled by the temperature of the coolant dielectric fluid in the transformer 10. The fan 22 is turned on during the operation of the apparatus of the present invention when the temperature within the transformer 10 exceeds the upper limit of the set temperature. The fan 22 is turned off during the operation of the apparatus of the present invention when the temperature within the transformer 10 falls below the lower limit of the lower set temperature. With the heat containment means 16 and the fan 22, the temperature of the coolant dielectric fluid in the transformer 10 can be maintained within its optimum reclassification temperature range. Without any heat containment means, and especially if the transformer 10 were outdoors, the temperature of the coolant dielectric fluid in the transformer 10 is totally dependant upon the ambient temperature and any heat normally created in the operation of transformer 10 would be dissipated and not conserved.

The transformer 10, when being decontaminated due to its use of PCBs as the coolant dielectric fluid, is drained, washed, and has appropriate fittings for easily attaching the lines for the apparatus of the present invention. Also provided are the necessary lines, valves and fittings to introduce the reclassification fluid and remove the PCBs and any contaminated cleaning fluid used to flush or clean the transformer.

The apparatus includes a line 28 for removing contaminated dielectric fluid from the transformer 10 and introducing the fluid to a pump 30. The pump 30 has a recirculation line 32 which extends to a reintroduction line 34, connected to the transformer 10 for reintroducing the coolant dielectric fluid into the transformer 10.

Line 28 and line 34 are attachable to the fittings referred to above. The transformer 10 and the recirculation lines are filled with a clean coolant dielectric fluid preferably perchloroethylene, which is preferably used in the flushing or cleaning operation described above, and then the transformer 10 is ready for normal operation.

A portion or all of the fluid passing through pump 30 may be passed through line 38 into a distillation means 40 which may be a single-stage or fractional distillation column for separating the PCBs from the contaminated fluid. Valve 33 in line 32 and valve 37 in valve 38 can be adjusted so that a portion, all, or none of the fluid is passed into the distillation means 40. In distillation means 40, an overhead vapor stream is removed by line 42, whereas a bottom stream 44 containing the PCBs is removed and disposed of properly.

Valves 46 in line 34 and 48 in line 32 can be adjusted so that all or a portion of the fluid continues in line 32 to pass through a venturi 50. Into the side of the venturi 50 is introduced the overhead vapor by line 52 which is removed by line 42 from the distillation means 40. The overhead vapor introduced by line 52, when introduced into the venturi 50 will condense and the heat released by its condensation is transferred into the recirculated coolant dielectric fluid as it is reintroduced into line 34 and to the transformer 10. The venturi 50 eliminates the use of a condenser such as an air-cooled or a water-cooled condenser which would condense the overhead vapor from line 42 of the distillation means 40 for and reintroduce the clean fluid to the transformer 10. With such a condenser, the heat in the overhead vapor is lost, as well as having a structure which is much greater in size. The apparatus of the present invention incorporates as one energy and space savings device a venturi which is used to conserve the heat introduced to the distillation and return that heat to the transformer. The use of the venturi also reduces the amount of instrumentation required. The venturi permits the balancing of pressure between a liquid stream and a vapor containing stream.

Figure 2:
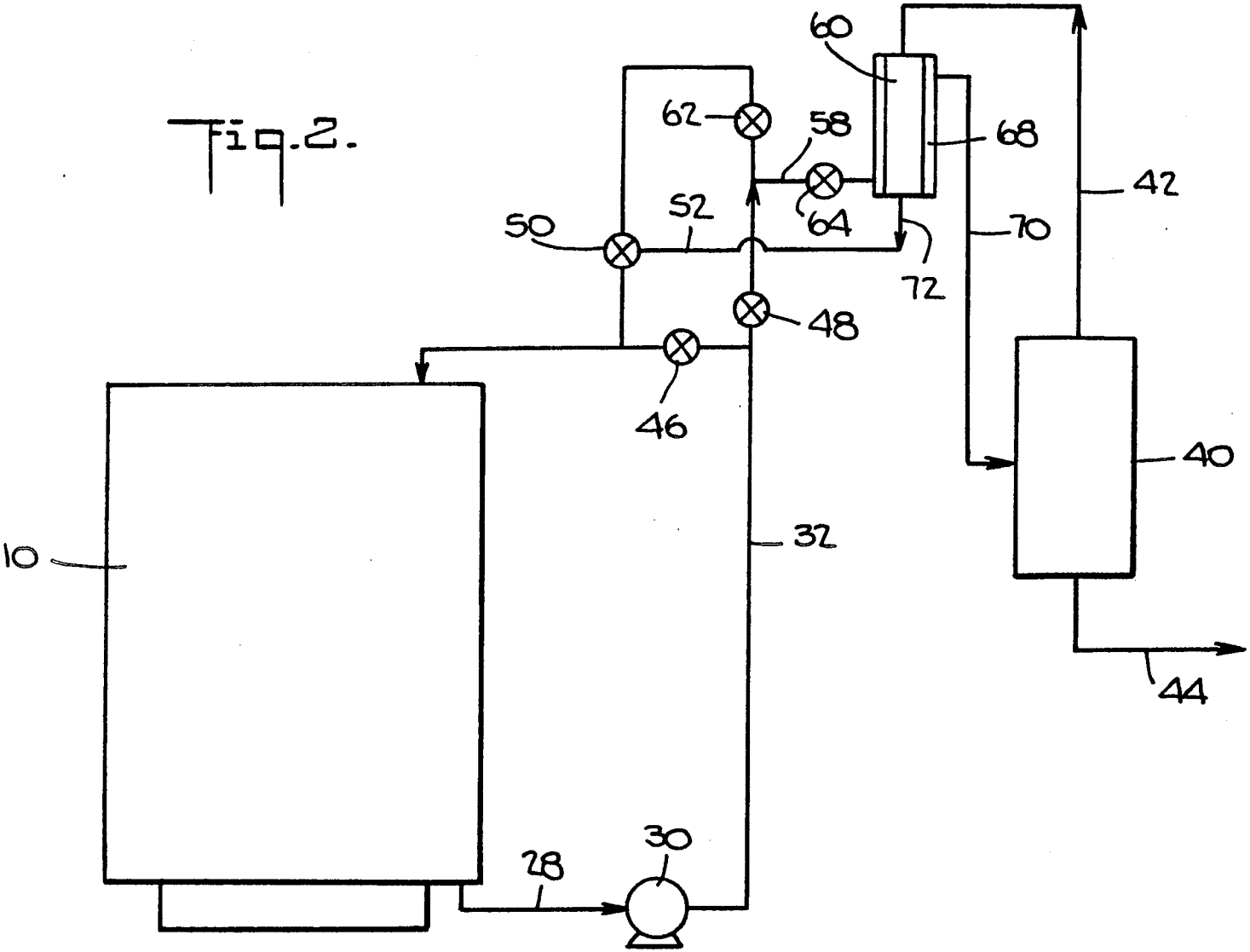
FIG. 2 is the schematic flow sheet wherein a liquid cooling condenser is used to aid in the heat management of the apparatus for decontaminating the electrical transformer.

Referring now to FIG. 2, another aspect of the present invention is disclosed with the common structure as that set forth in FIG. 1 having the same reference numerals. In this embodiment illustrating the use of more than one energy saving device, the coolant dielectric fluid, after being removed from the transformer 10 by line 28 and introduced into pump 30, passes through line 32 whereby a portion of the fluid may be introduced through line 58 into a liquid-vapor heat exchange device or a condenser 60. The amount of fluid introduced into the line 58 is controlled by valves 62 in line 32 and 64 in line 58, so that a portion goes into line 58 and another portion continues in line 32. The portion of fluid in line 32 is then passed through venturi 50. The fluid introduced by line 58 into condenser 60 is introduced in its outside shell 68 whereby it is removed from the upper portion of condenser 60 by line 70. The overhead vapor stream from distillation means 40 is removed by line 42 and is cooled by passing the vapor stream through the inside tube of the condenser 60 and removed by line 72 whereby it is introduced into line 52 and then into venturi 50. The heated fluid in line 70 is introduced to distillation means 40. In this embodiment the coolant dielectric fluid removed from the transformer 10 is preheated before being introduced into the distillation means 40. Such heating reduces the heating requirement in the distillation means 40 as well as providing a way of capturing the heat from the overhead vapor stream from distillation means 40. All of the heat obtained by heat transfer in using a condenser 60 provides heat savings in the distillation means 40 which would otherwise require additional energy to heat up the incoming coolant dielectric fluid. This heat would otherwise be lost if an air condenser for condensing the overhead vapor from the distillation column 40 were used. It will be noted that the energy management is not done by sophisticated control equipment or by attempting to provide temperatures within certain ranges for operation, but is accomplished by maximizing the recovery of heat by using specific combinations of energy saving devices. With the combination of a venturi and a vapor-liquid condenser illustrated in this embodiment, the energy requirements of the distillation means 40 is reduced by the preheating of the liquid in the condenser before it is introduced to the means 40 and by transfer of the heat from the vapor into the fluid returning to the transformer 10. The venturi 50 will recover heat from the overhead fluid if the fluid is vapor or liquid or a combination thereof. If the overhead vapor is partly liquid and partly a gas, the liquid and/or gas introduced by line 52 provides a combination wherein the heat is recovered and introduced to the returning fluid to the transformer 10. With the combination of specific devices illustrated in this embodiment, the heat saved is substantial and the heat management of the transformer is significant since heat is retuned to the transformer which in the past was lost. Of particular importance is that the combination does not increase the size of the apparatus.

Figure 3:
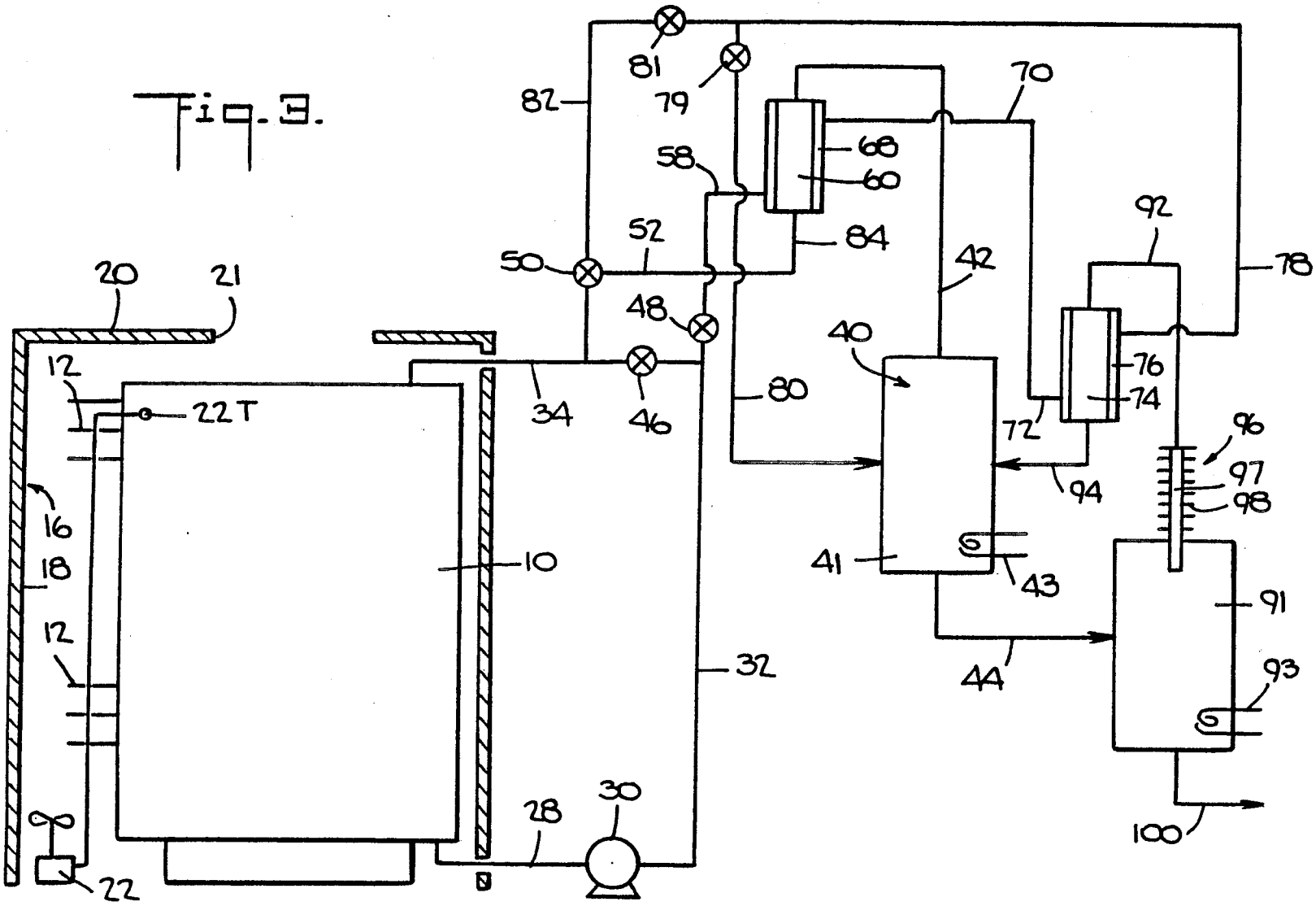
FIG. 3 is a schematic flow sheet of a preferred embodiment of the apparatus of this invention as applied to reclassifying a PCB-contaminated electrical transformer.

Referring now to FIG. 3, which is a preferred embodiment, the same reference numerals will be used on common structure as those disclosed in either FIG. 1 or FIG. 2. In this embodiment an electrical transformer 10 or other electrical device which had been operating with PCB as the coolant dielectric fluid is drained, cleaned, and fittings placed on the lines for introducing a different coolant dielectric fluid than PCBs. The preferred cleaning or reclassification fluid, perchloroethylene, is introduced into the transformer in an amount in excess to fill the transformer 10.

The transformer 10 has fins 12 which air-cool the coolant dielectric fluid in the transformer. Surrounding the fins 12 of the transformer 10 is a heat-containment means 16, which includes a baffle 18 and an upper portion 20 to confine a defined amount of air within means 16 and control the flow of air out through the opening 21 at the top of the transformer 10. To control the temperature within the transformer, a fan 22 is positioned between the baffle 18 and the transformer 10 which, when turned on, creates a flow of air over the fins 12 which are the heat exchange surfaces of the transformer 10 to cool the fluid in the transformer 10. The fan 22 is turned on by use of a thermocouple 22T or other temperature sensing switch or controller (as is well-known in the art), when the temperature exceeds a set temperature so that the cleaning or reclassification fluid will not exceed its optimum elevated temperature.

A line 28 is connected to the transformer 10 for removal of the contaminated coolant dielectric fluid for introduction into a pump 30. On the outlet side of the pump 30 is a line 32 which has a line 34 for reintroducing the fluid into the transformer 10.

In this preferred embodiment, valve 46 in line 34 and valve 48 in line 32 can be adjusted so that all or a portion of the fluid in line 32 is introduced by line 58 to liquid-vapor heat exchange means or condenser 60.

Condenser 60 has an outer shell 68 which receives the coolant dielectric fluid at the bottom thereof. The fluid is removed from the top of the shell 68 by line 70.

As shown in FIG. 3, the fluid which has been heated in condenser 60 is then introduced by line 72 into a second liquid-vapor heat exchange means or liquid condenser 74. Condenser 74 has an outer shell 76 wherein the heated liquid from condenser 60 is introduced at the bottom by line 72 an is removed from the top thereof by line 78. The heated dielectric fluid is then carried by line 78 and a portion is introduced by line 80 to the distillation means 40 and another portion is carried by line 22 to the venturi 50. Valves 79 in line 80 and valve 81 in line 82 adjust the proportion passing through each of lines 80 and 82, respectively.

The distillation means 40 in this embodiment comprises a first single-stage distillation column 41 and a second single-stage distillation column 91. In the single-stage columns 41 and 91, there are no trays or reflux condensers and control systems which are the usual equipment pieces required in multi-stage or fractional distillation columns. The columns are heated by a heater 43 and a heater 93, respectively. In each of the columns, an overhead vapor is formed and the overhead vapor from column 41 is removed by line 42, which is then cooled by passing through condenser 60. The cooled fluid is then removed by line 84 and introduced by line 52 into the side of the venturi 50. The bottom stream from the first single-stage distillation column 41 is removed by line 44 and introduced into the second single-stage distillation column 91. In column 91, an overhead vapor is removed by line 92 and introduced into the condenser 74 whereby the overhead is cooled and removed by line 94 for reintroduction into the first single-stage distillation column 41.

Another energy saving device of the present invention is an air-cooled condenser 96 at the top of the distillation column 91. The condenser 96 is simply a small metal tube 97, which may have a plurality of fins 98 for increasing the heat transfer rate. The tube 97 may be packed with packing material, if desired The condenser 96 will partially condense a portion of the overhead vapor stream and the condensed liquid drips back into the distillation column 91. The condenser 96 is a rectifier and not the kind of condenser that would be used in a multi-staged distillation column. In a multi-stage column, the condenser will condense a sufficient liquid stream to provide a reflux stream which is introduced to the top of the column and requires control equipment to measure temperatures and reflux ratios. There are no controllers associated with condenser 96. This condenser simply aids in increasing the efficiency and the effectiveness of the distillation when the dielectric fluids which are being cleaned or reclassified contain multiple chemical components, and a specific compound, while not PCBs, is not a desired component of the dielectric fluid which ultimately is to be used in the operation of or in cleaning the transformer 10. A specific example is reclassifying an askaral transformer with perchloroethylene as the cleaning fluid. When the original dielectric fluid of the contaminated transformer 10 was an askaral, the askaral fluid contained not only the polychlorinated biphenyls (PCBs), but also a substantial amount of trichorobenzene as a solvent. The condenser 96 is advantageous in cleaning or reclassifying an askaral transformer, since the trichlorobenzenes, which have a much lower boiling point than the biphenyls, are preferentially condensed with respect to the tricholoroethylene cleaning fluid by condenser 96 so that the trichlorobenzenes can be removed and withdrawn with the bottoms by line 100. In this instance the cleaning fluid, trichloroethylene, has a lower boiling point than the trichlorobenzene and will not condense in the condenser 96.

The embodiment as illustrated in FIG. 3 is a compact, energy saving and efficient apparatus for use in the decontamination or reclassifying of an electrical transformer. The compactness comes from the various combination of the energy saving devices of the present invention as set forth hereinabove and provides an apparatus wherein the heat management of the transformer being reclassified or cleaned is maximized. Efficiency is built into the apparatus without the incorporation of large pieces of apparatus, controls, and control circuits or the use of any complex pieces of equipment. Furthermore, the apparatus may be operated without the need for anyone in attendance. The dielectric fluid is heated by utilizing the heat in the vapor streams formed in the distillation thereby reducing the amount of energy necessary in the distillation column(s). Single-stage distillation columns are utilized so that all that is necessary is a heater which may be accomplished by an electric heater or any other heat exchange equipment available to essentially boil the liquid in the distillation means. The liquid which is used in the cleaning process is preferably perchloroethylene which has a low boiling point and is a good dielectric fluid, both for cleaning as well as the dielectric fluid used in the final operation of the transformer.

The apparatus of the present invention can be attached to the transformer 10 and the transformer may be placed in operation, even as it is being cleaned or reclassified. One of the features of the present invention is to return the dielectric fluid which has been cleaned at maximum operating temperature range to maintain the dielectric fluid in the transformer as hot as possible in order to enhance the rate at which PCBs are withdrawn or eluted from in the core of the transformer for thorough and complete cleaning thereby reducing the time to reach the non-PCB transformer standard. Thus, the heat generated in the transformer during its operation as well as the energy or heat in the apparatus system used to reclassify the transformer is recovered and used. On the other hand, if the temperature of the fluid within the transformer rises above the desired maximum operating temperature, fan 22 can be energized, passing sufficient air across the fins 12 for cooling the fluid in the transformer 10. This will assure that the temperature does not rise to an unacceptable level within the transformer 10.

It is understood that a preferred embodiment has been set forth and described; however, one or more of the energy saving devices may be employed and there are many modifications that are possible which will employ the principles which have been disclosed.

What is claimed:

1. An apparatus for cleaning fluid contaminate with polychlorinated biphenyls which includes means for removing said contaminated fluid from a contaminated apparatus, a distillation means to receive said contaminated fluid configured to form an overhead vapor stream consisting essentially of decontaminated fluid and a bottoms stream containing said polychlorinated biphenyls, and means for returning fluid to said contaminated apparatus, the improvement which comprises:

a venturi configured to receive a portion of the returning fluid, as a liquid, which is passed through said venturi and having a side port for receiving at least a portion of said overhead vapor stream whereby the heat in said vapor stream is recovered in said returning liquid fluid.

2. An apparatus for cleaning contaminated liquid which comprises:

(a) means for removing from a contaminated apparatus which is being decontaminated said contaminated liquid;

(b) distillation means to receive a portion of said contaminated liquid configured to form an overhead vapor stream consisting essentially of decontaminated liquid and a bottoms stream containing said contaminant; and (c) means for returning liquid to said apparatus which is being decontaminated;

said means including a venturi for passing a portion of returning liquid fluid through said venturi and having a side port for receiving a portion of said overhead vapor stream.

3. An apparatus according to claim 2 wherein said overhead vapor stream has been condensed and liquid is introduced into said side port.

4. An apparatus according to claim 2 which further includes:

liquid-vapor heat transfer means wherein said contaminated liquid removed from said contaminated apparatus is heated by said overhead vapor stream.

5. An apparatus according to claim 4 which further includes:

means for introducing said heated contaminated liquid from said liquid-vapor heat transfer means to said distillation means.

6. An apparatus according to claim 2 wherein said distillation means includes:

a first single-stage distillation column to receive said contaminated liquid configured to form an overhead vapor stream consisting essentially of decontaminated liquid and a bottoms stream containing said contaminant; and a second single-stage distillation column to receive said bottoms stream configured to form a second overhead vapor stream and a second bottoms stream containing said contaminant.

7. An apparatus according to claim 6 which further includes:

liquid-vapor heat transfer means wherein said contaminated liquid removed from said contaminated apparatus is heated by said overhead vapor stream.

8. An apparatus according to claim 7 wherein liquid-vapor heat transfer means includes:

a first liquid-vapor heat transfer means wherein said contaminated liquid removed from said contaminated apparatus is heated by said overhead vapor stream;

a second liquid-vapor heat transfer mean wherein said contaminated liquid removed from first said contaminated apparatus is heated by said second overhead vapor stream.

* * * * *